US005964058A

United States Patent [19]

Richardson

[11] Patent Number: 5,964,058

[45] Date of Patent: Oct. 12, 1999

[54] ELECTROSENSING EDGE FOR DOOR

[76] Inventor: Layne E. Richardson, 620 Robinhood, Shreveport, La. 71106

[21] Appl. No.: 09/134,742

[22] Filed: Aug. 14, 1998

Related U.S. Application Data

[60] Provisional application No. 60/056,019, Aug. 18, 1997.

[51] Int. Cl.[6] ..... E05F 15/02

[52] U.S. Cl. ..... 49/27

[58] Field of Search ..... 49/26, 27, 28; 200/61.43

[56] References Cited

U.S. PATENT DOCUMENTS

| | | | |
|---|---|---|---|
| 2,135,131 | 11/1938 | Bassett | 49/27 X |
| 3,352,059 | 11/1967 | Metz | 49/27 |
| 5,079,417 | 1/1992 | Strand | 49/27 X |
| 5,259,143 | 11/1993 | Mitchell | 49/27 |
| 5,260,529 | 11/1993 | Miller | 200/61.43 |
| 5,262,603 | 11/1993 | Miller | 200/61.43 |
| 5,327,680 | 7/1994 | Miller | 49/27 |
| 5,384,982 | 1/1995 | Galperin | 49/27 |
| 5,438,798 | 8/1995 | Plamper | 49/28 |
| 5,481,076 | 1/1996 | Mullet | 200/61.43 |
| 5,589,811 | 12/1996 | Pariot | 338/210 |
| 5,602,370 | 2/1997 | Kau | 200/61.43 |

*Primary Examiner*—Jerry Redman
*Attorney, Agent, or Firm*—John M Harrison

[57] ABSTRACT

An electrosensing edge which automatically reverses the downward closing movement of a door such as a garage door when a sealing member and the electrosensing edge encounter an obstruction. The electrosensing edge is characterized by an elecricial cable which extends between two insulators located at each end of a metal bracket mounted on the leading edge of the door, inside the sealing member suspended from the bracket. The cable acts as a witch which is normally open, but is closed if the cable is forced against the bracket to ground the electrical circuit as the sealing member and cable strike the obstruction. Grounding of the cable trips a relay and causes the door actuator to immediately reverse downward movement of the door without injury or damage to the obstruction.

13 Claims, 3 Drawing Sheets

Rev. Mtr.
Input Voltage

ELECTROSENSING EDGE FOR DOOR

CROSS-REFERENCE TO RELATED APPLICATIONS

This application claims the benefit of U.S. Provisional Application Ser. No. 60/056,019 filed Aug. 18, 1997.

BACKGROUND OF THE INVENTION

1. Field of the Invention

This invention relates to safety edge assemblies for movable closures such as garage doors and more particularly, to an electrosensing edge for automatically reversing the downward movement of the door when the edge sealing member encounters an obstruction during closing. In a preferred embodiment the electrosensing edge includes an elongated metal bracket which is mounted on the leading edge of the door and the sealing member is suspended from the bracket and traverses the width of the door. A spring-loaded cable capable of carrying an electric current extends between two insulators located at each end of the metal bracket inside the sealing member and the cable acts as a switch which is normally open but is closed if the door strikes an object and the cable is consequently forced against the bracket, to ground. Accordingly, contact of the cable with the bracket between the insulating blocks closes an electrical circuit, trips a relay and causes the actuator to reverse downward movement of the door, without injury or damage to the object which it strikes.

Since the passing of 1995 Federal legislation that governs the parameters of safety devices installed on residential garage door operators, most manufacturers rely on a fail-safe photo cell system set up in conjunction with a load sensor on the motor. The load sensor on the operator will reverse the motor if the load increases past a pre-determined level. The system will also reverse if the photo cells are obstructed. Part of the fail-safe system designed into these operators is the ability for the system to detect a short in the photo beam wires. If the operator is in the downward mode and a short condition exists, the beam then becomes inoperable and the door reverses and travels to the open position. The safety edge of this invention is designed to create a short in these photo cell wires, which will create a condition that will reverse the door. The fail-safe adaptation feeds power to the photocells through the bottom safety edge. If an interruption in current were to exist, the photo cell setup will become inoperable, and the door will reverse if coming down and will not operate until current is restored to the photocells.

For many years, sensing edges have been used in the doors of garages and commercial and utility buildings to stop or reverse closing movement of the door in the event that the door encounters an obstruction. Originally, most garage or large commercial doors were manually operated, with large or extremely heavy doors counterbalanced to permit opening and closing by one person. The requirement for mechanical assistance in the operation of large doors in commercial installations and more recently, garage doors, has resulted in the use of electric motors to power the opening and closing of such doors. Along with the use of electric motors has arisen the safety concern of a power-operated door closing with a person, animal or object in the path of the door. This consideration prompted the widespread use of radio-operated remote control devices to actuate the closing and opening of such doors from a distance or from an obstructed vantage point where it is difficult or impossible to ascertain that the closing door is free of obstructions.

2. Description of the Prior Art

Generally, two approaches have been taken to implement mechanisms for stopping or reversing a garage door when an obstruction is encountered by the closing door. In one application, the motor or drive train effecting the closing and opening of the door is adapted to sense substantially increased resistance to closing of the door. While affording a degree of safety protection, devices of this type often require frequent and precise readjustment and are otherwise prone to malfunction. Another type of application utilizes the installment of a mechanical actuator, an electrical switch or a sensor on the leading edge of the door to engage any object which might be encountered during closing of the door and actuate suitable controls to stop and/or reverse the motor which drives the door. Typical of these edge-mounted sensing devices is the "Astragal for Closure Members" described in U.S. Pat. No. 5,259,143, dated Nov. 9, 1993, to Albert W. Mitchell, et al. The astragal is characterized by an elongated, arcuate sealing member which traverses the leading edge of a closure such as a garage door, a pair of electrically-conductive strips extending the length of the sealing member in vertically-spaced relationship and a switch electrically connected to the conductive strips for reversing downward movement of the door in the event that the sealing member engages an obstruction and the conductive strips contact one another. U.S. Pat. No. 5,260,529, dated Nov. 9, 1993, to Bearge D. Miller, discloses a "Sensing Edge For A Door Including A Switch And Flexible Protruding Sensing Members", which includes an elongated, flexible sheath which is attached to the leading edge of a closure such as a garage door. A switch provided in the sheath operates to reverse the direction of travel of a closing door after the door strikes an obstruction. A "Sensing Edge" is disclosed in U.S. Pat. No. 5,262,603, dated Nov. 16, 1993, to Bearge D. Miller. The sensing edge is characterized by a base member which is secured to the leading edge of a door and a sheath having a pair of upper and lower internal cavities traverses the length of the sheath and the bottom sheath receives a pair of upper and lower electrical contacts. Contact of the closing door with an obstruction causes the electrical contacts to engage each other and operate the door actuator to automatically reverse the direction of travel of the door. An electrical connector positioned in the sheath connects the electrical contacts to provide a fail-safe feature for detecting electrical problems in the electrical contacts. U.S. Pat. No. 5,384,982, dated Jan. 31, 1995, to Anatoly Galperin, describes a "Sensing Device Having Universal Interface For Cooperation With Plurality of Door Actuators". The sensing edge includes an elongated, flexible sheath mounted on the leading edge of a door and a pair of generally parallel, vertically-spaced contact members are disposed in the sheath and electrically connected to the door actuator. A termination circuit, electrically connected to the contact members, continuously generates a predetermined output voltage which is applied through the contact members to the actuator to facilitate selective closing of the door by the actuator. Upon application of a force to the sensing edge, the contact members contact each other to pr event the termination circuit output from being applied to the actuator, thereby causing the actuator to stop or reverse the direction of movement of the closing door. U.S. Pat. No. 5,438,798, dated Aug. 8, 1995, to Gunter Plamper, et al, details a "Safety Edge Assembly For A Movable Closure", including an electrically-conductive mounting rail which is mounted on the leading edge of the door. A deformable tubular member is suspended from the mounting rail and a conductive member on the tubular member is movable from a first position normally spaced from the conductive mounting rail into a second position engaging the conductive mounting rail, to complete an electrical circuit for reversing the t ravel direction of the closing door upon deformation of the tubular member. A "Power Door Safety Sensing Strip" is disclosed in U.S. Pat. No. 5,589,811, dated Dec. 31, 1996, to Robert Pariot, et al. The power door safety sensing strip includes a Z-shaped support bracket which is attached to the face of a power-operated garage door, and a flexible, tubular insulating member is suspended from the support bracket a short distance beyond the bottom edge of the door. A flat insulating member extends vertically from the support bracket, through the interior of the tubular insulating member and conductive surfaces on the flat insulating member and interior of the tubular insulating member are moved into contact upon deformation of the tubular insulating member, thereby reversing the direction of travel of the closing door. U.S. Pat. No. 5,602,370, dated Feb. 11, 1997, to David Kau, details a "Safety Switch For Electric Rolling Doors", including a plastic follower bar fastened to the bottom rail of an electric-powered rolling door and having two ribs on the inside of the follower bar. Two metal sheets mounted inside the follower bar above the ribs are separated by a slotted insulator sheet, and two actuators are fastened to opposite ends of the bottom rail of the electric rolling door. Each actuator includes a top plate fastened to one end of the bottom rail and two crossed pressure bars pivoted to the top plate. When the follower bar or actuator contacts an object during closing of the door, the follower bar is deformed to force the ribs upwardly against the metal sheets, which contact each other through openings in the insulator sheet and cause termination of the power supply to the electric motor powering the door.

An object of this invention is to provide an electrosensing edge of high reliability for automatically reversing closing movement of a door when the door encounters an obstruction.

Another object of this invention is to provide an electrosensing edge which is mounted on the leading or bottom edge of a vertical door such as a garage door and senses the presence of an obstruction in the path of the closing door, thus causing the door actuator to quickly reverse downward movement of the door and prevent injury or damage to the obstruction.

Still another object of this invention is to provide an electrosensing edge for an automatic, vertically-operated door, which edge includes an elongated, metal mount bracket that extends along the leading or bottom edge of the door, a typically rubber or plastic sealing member suspended from the mount bracket and a spring-loaded electrical cable extended between two insulators located at each end of the bracket inside the sealing member and acting as a switch which is normally open, but is closed if the door strikes an obstruction and the cable is forced against the mount bracket, thereby grounding the circuit and reversing downward movement of the closing door without injury or damage to the obstruction.

SUMMARY OF THE INVENTION

These and other objects of the invention are provided in an electrosensing edge which is mounted on the bottom edge of a an overhead garage or warehouse door to sense the presence of an obstruction in the path of the closing door and cause the door to immediately reverse downward movement without injury or damage to the obstruction. In a preferred embodiment the electrosensing edge can be used with or without photo cells and is characterized by a metal mount bracket which is mounted on the bottom or leading edge of the garage door, and a sealing member is suspended from the bracket. An electrical cable extends between two insulators located at opposite ends of the mount bracket inside the sealing member and the cable is connected to an electrical circuit which is normally open, but closes if the sealing member of the closing door strikes an obstruction and forces the cable against the metal mount bracket, thus grounding the circuit, tripping a relay and operating the actuator to reverse downward movement of the door without injury or damage to the obstruction.

BRIEF DESCRIPTION OF THE DRAWINGS

The invention will be better understood by reference to the accompanying drawings, wherein.

DESCRIPTION OF THE PREFERRED EMBODIMENTS

Figures 1, 2:
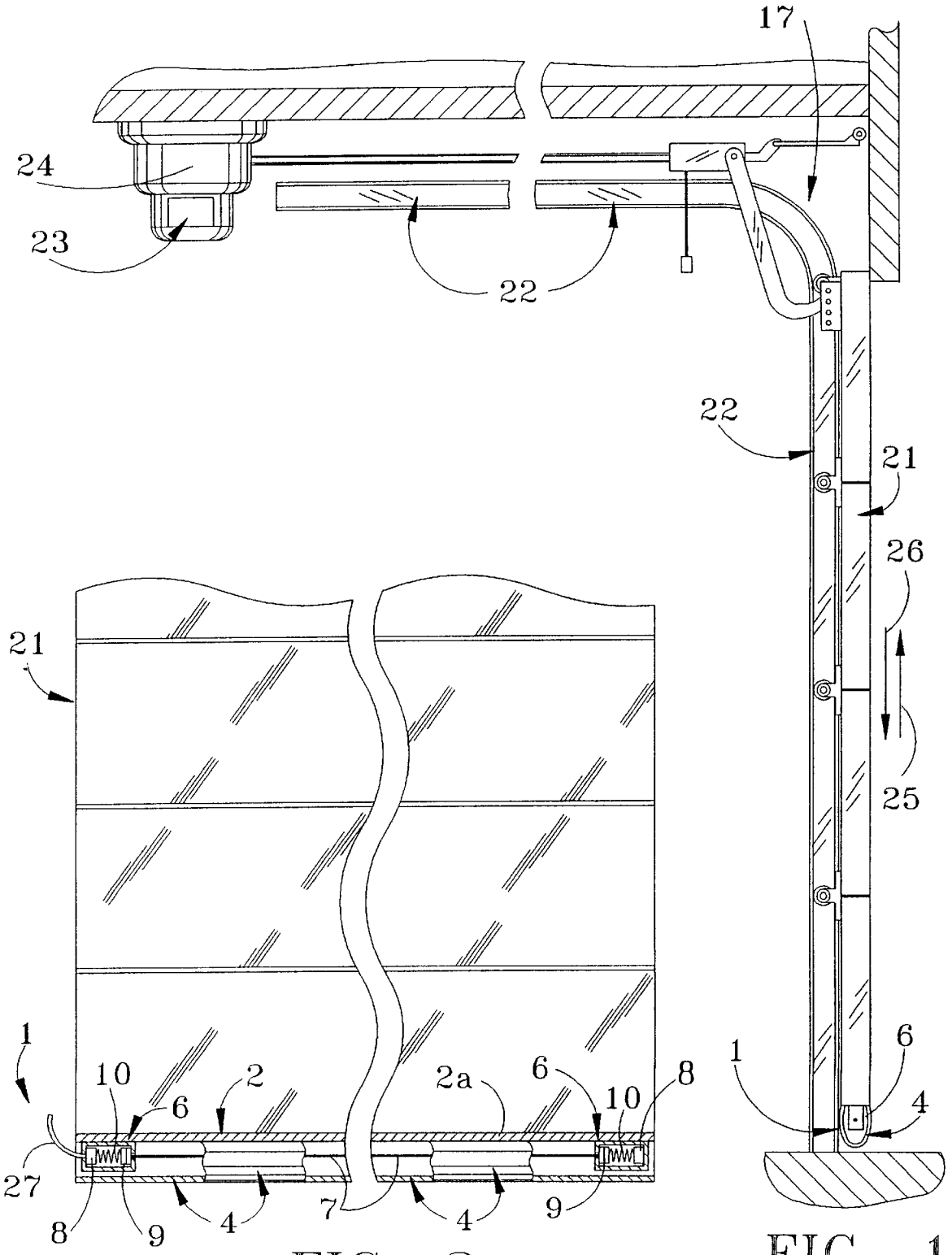
FIG. 1 is a side view of a vertically-operated garage door and track, with a preferred embodiment of the electrosensing edge of this invention mounted in functional configuration on the door.
FIG. 2 is a front view, partially in section, of the garage door and electrosensing edge illustrated in FIG. 1.
Figures 3, 4, 4A, 5:
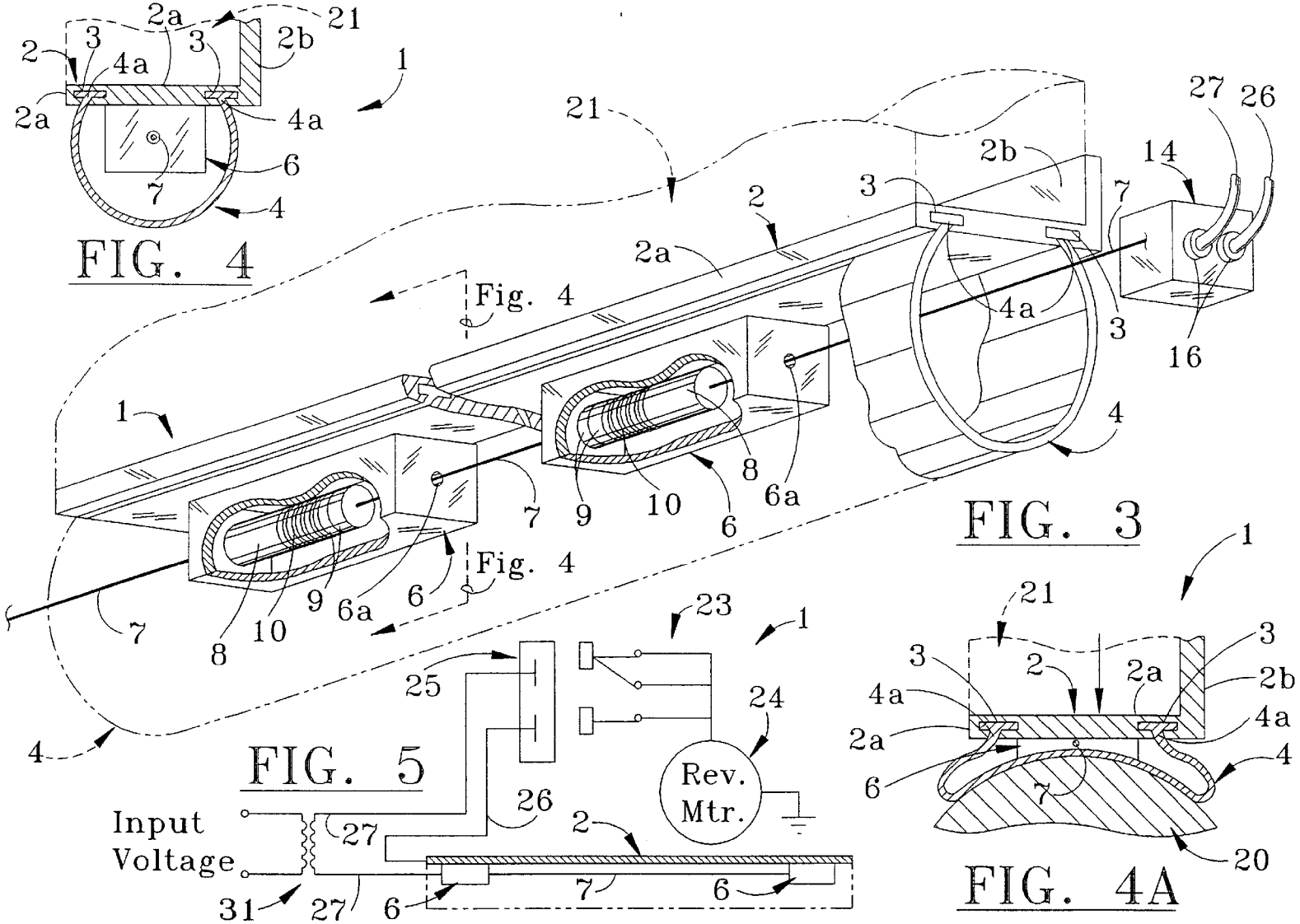
FIG. 3 is a perspective view, partially in section, of the electrosensing edge of this invention, more particularly illustrating a preferred technique for mounting the cable component of the electrosensing edge with respect to the mount bracket.
FIG. 4 is a side sectional view of the electrosensing edge of this invention normally deployed in non-functional configuration.
FIG. 4A is a side sectional view of the electrosensing edge of this invention in operation.
FIG. 5 is a schematic of a typical transformer, relay and operating circuit.

Referring initially to FIGS. 1–4 of the drawings, in a preferred embodiment the electrosensing edge of this invention is generally indicated by reference numeral 1. The electrosensing edge 1 includes an elongated metal mount bracket 2 having a horizontal segment 2*a* and a vertical segment 2*b*, which is mounted on the bottom edge of a garage door 21, selectively raised and lowered on curved rails or tracks 22, by operation of an electric actuator 23 and motor 24, as illustrated in FIG. 1. Bolts or screws (not illustrated) are typically extended through the vertical segment 2*b* of the mount bracket 2 and threaded into the garage door 21 to secure the mount bracket 2 thereon. As illustrated in FIG. 3, a pair of parallel, T-shaped support channels 3 are typically shaped in the bottom surface of the horizontal segment 2*a* of the mount bracket 2 and extend along the entire length thereof. An elongated, typically, rubber sealing member 4 includes a pair of support flanges 4*a* shaped along the edges thereof and are slidably inserted in the respective correspondingly-shaped support channels 3 in the mount bracket 2. An electrical insulator 6, constructed from a suitable electrically-insulating material, is mounted on the bottom surface of the horizontal segment 2*a*, adjacent to each end of the mount bracket 2. As illustrated in FIG. 2, each end of an electrically-conductive sensing cable 7 is fixedly attached to a cylindrical cable clamp 8, and the sensing cable 7 extends through aligned cable openings 6*a* provided in the respective electrical insulators 6, as further illustrated in FIG. 3. A tension spring 10 and pair of washers 9, mounted on the sensing cable 7, are typically interposed between each cable clamp 8 and the corresponding electrical insulator 6, which tension springs 10 exert tension on the sensing cable 7 to maintain the sensing cable 7 in taut configuration and normally spaced from the horizontal segment 2*a* of the mount bracket 2, between the electrical insulators 6.

Referring next to FIGS. 1, 3 and 5 of the drawings, a relay box 14 is typically attached to the vertical segment 2*b* of the mount bracket 2, typically by means of mount bolts or screws (not illustrated), and houses a relay 25 and a transformer 31. One end of a length of mount bracket wiring 26 terminates at the mount bracket 2 and the other end is attached to one pole of the relay 25, located in the interior of the relay box 14. Also located inside the relay box 14, one end of a sensing cable wiring 27 extends through a winding of the transformer 31 to the sensing cable 7 and the other end is connected to a second pole of the relay 25. The mount bracket wiring 26 and sensing cable wiring 27 typically extend through grommets 16, provided in the side of the relay box 14, up the interior face of the garage door 21, to the actuator 23 and motor 24, illustrated in FIG. 1, and continually receive an electrical current from a suitable source, which is conventionally connected to the transformer 31, during operation of the actuator 23, as hereinafter further described.

As illustrated in FIGS. 1, 4 and 4A, the electrosensing edge 1 normally operates with the sealing member 4 pressed in normal closing configuration against the floor of a garage or shop. however, if an object 20 such as a baby or a small animal is contacted by the sealing member 4 and the sensing cable 7 as illustrated in FIG. 4A, the system is activated as follows: since the mount bracket wiring 26 is electrically connected to one of the poles of the relay 25 and the relay 25 is connected to the actuator 23, the relay 25 energizes the actuator 23 to raise the garage door 21 on the tracks 22, as indicated by the arrow 25, during normal operation of the actuator 23. As heretofore described, the sensing cable wiring 27 is connected to one end of the sensing cable 7 in one of the cable clamps 8, as illustrated in FIG. 2. Heat-shrunk cable tubing (not illustrated) typically seals the connection of the sensing cable wiring 27 with the sensing cable 7, for water-proofing purposes, as deemed necessary.

In application of the electrosensing edge 1, as the actuator 23 and motor 24 are operated to lower the garage door 21 on the tracks 22 as indicated by the arrow 26 in FIG. 1, an electric current flows from the actuator 23, through the mount bracket wiring 26 and the sensing cable wiring 27 to the relay 25 in the relay box 14. Because the sensing cable 7 is normally out of contact with the mount bracket 2, the circuit operating the garage door lifting function of the actuator 23 is open, such that the garage door 21 continues downwardly. However, if the descending garage door 21 strikes an obstruction such as a person, animal or object 20 as illustrated in FIG. 4A, the sealing member 4 is forced upwardly against the sensing cable 7, which is caused to contact the horizontal segment 2*a* of the mount bracket 2. This action establishes electrical contact between the mount bracket 2 and sensing cable 7, such that the relay 25 is activated and the reversal circuitry of the actuator 23 is thus energized, automatically raising the garage door 21 as indicated by the arrow 25 and thereby averting injury or damage to the obstruction.

Figure 6:
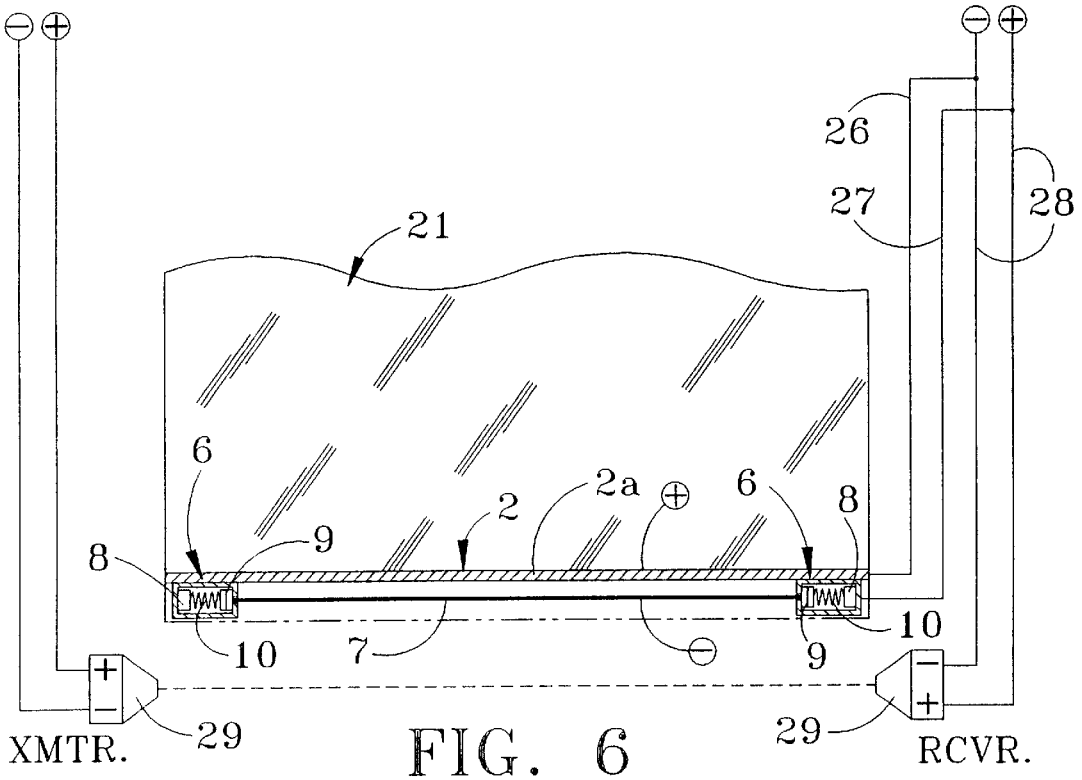
FIG. 6 is a schematic of a typical operating circuit using photo cell sensors.
Figure 7:
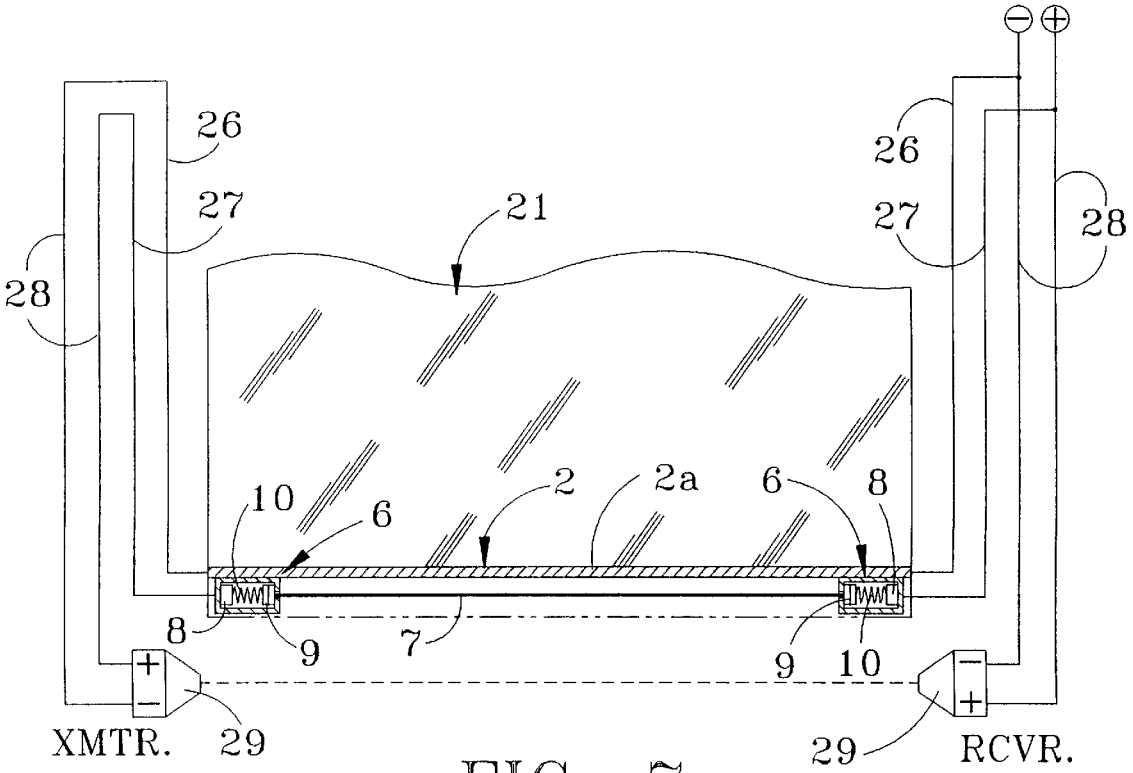
FIG. 7 is a schematic of an alternative operating circuit using photo cell sensors.

As further illustrated in FIGS. 1, 6 and 7 the electrosensing edge of this invention can be used in connection with a garage door 21, actuator 23 and a motor 24 that utilize photo cells 29 to avert closure of the garage door 21 in the event of an obstacle. The electrosensing edge 1 can be wired into the photocell wiring 28, either in the configuration illustrated in FIG. 6 or FIG. 7 to cause the photo cells 29 to become inoperable in the course of reversing the garage door 21 as described herein.

Referring to FIG. 5 of the drawings, and as heretofore described, the typical relay 25 setup of this invention allows the electrosensing edge 1 to be used as an electric switch, which in turn controls the relay 25, that controls the direction of the garage door 21 as described above. The relay coil is energized as the sensing cable 7 contacts an object, such as the obstruction or object 20 illustrated in FIG. 4A. The normally closed terminals of the relay 25 are typically wired in series with a down limit switch (not illustrated), while the normally-open contacts of the relay 25 are typically wired to the operators open control circuit; accordingly, when the door is traveling downward, should it come in contact with an object 20, it will stop and reverse.

Another variation of this electrosensing edge is use of the center electrode as an antenna which, in turn, is electrically connected hooked to a microprocessor capable of detecting an object or human before physical contact is actually made. The purpose of this device is also to reverse the downward direction of the door before contact is made to an actual object.

While the preferred embodiments of the invention have been described above, it will be recognized and understood that various modifications may be made in the invention and the appended claims are intended to cover all such modifications which may fall within the scope and spirit of the invention.

Having described my invention with the particularity set forth above, what is claimed is:

1. An electrosensing edge for reversing downward movement of a vertically-operated door by an actuator, said electrosensing edge comprising a relay electrically connected to the actuator; a first electrical contact attached to the bottom edge of the door, said first electrical contact electrically connected to the relay and a second electrical contact attached to the door in normally spaced, non-conducting relationship to said first electrical contact, said second electrical contact also electrically connected to the relay for establishing electrical communication between said first electrical contact, said second electrical contact and said relay when said second electrical contact contacts said first electrical contact during operation of the actuator, whereby contact of said second electrical contact with said first electrical contact responsive to said downward movement of the door operates said relay and reverses the actuator and downward movement of the door.

2. The electrosensing edge of claim 1 comprising a resilient sealing member suspended from the door and wherein said first electrical contact and said second electrical contact are disposed inside said sealing member.

3. The electrosensing edge of claim 2 wherein said first electrical contact comprises a mount bracket substantially co-extensive with the bottom edge of the door and said sealing member is suspended from said mount bracket.

4. The electrosensing edge of claim 1 wherein said second electrical contact comprises a sensing cable.

5. The electrosensing edge of claim 4 comprising a resilient sealing member suspended from the door and wherein said first electrical contact and said sensing cable are disposed inside said sealing member.

6. The electrosensing edge of claim 5 wherein said first electrical contact comprises a mount bracket substantially coextensive with the bottom edge of the door and said sealing member is connected to said mount bracket.

7. The electrosensing edge of claim 1 wherein said first electrical contact comprises a mount bracket substantially coextensive with the bottom edge of the door and further comprising a pair of electrical insulators located substantially at opposite ends of said mount bracket and wherein said second electrical contact extends between said electrical insulators.

8. The electrosensing edge of claim 7 comprising a resilient sealing member suspended from said mount bracket, and wherein said second electrical contact extends inside said sealing member.

9. The electrosensing edge of claim 7 wherein said second electrical contact comprises a sensing cable.

10. The electrosensing edge of claim 7 wherein said second electrical contact comprises a sensing cable and comprising a resilient sealing member suspended from said mount bracket, and wherein said sensing cable extends inside said sealing member.

11. An electrosensing edge for reversing downward movement of a vertical door by an actuator when the door encounters an obstruction, said electrosensing edge comprising a relay electrically connected to the actuator; an electrically conductive mount bracket attached to the bottom edge of the door, said mount bracket electrically connected to said relay for receiving an electrical current during operation of the actuator; a pair of electrical insulators provided on said mount bracket in spaced-apart relationship with respect to each other; an electrically conductive sensing cable extending between said electrical insulators in normally spaced, non-conducting relationship with respect to said mount bracket, said sensing cable also electrically connected to said relay, whereby contact of said sensing cable with said mount bracket responsive to contact between the door and the obstruction completes an electrical circuit through the actuator for reversing operation of the actuator and downward movement of the door; and a cable clamp provided on each end of said sensing cable and a tension spring interposed between said cable clamp and said electrical insulator for exerting tension on said sensing cable.

12. The electrosensing edge of claim 11 comprising a resilient sealing member suspended from said mount bracket, and wherein said sensing cable is disposed inside said sealing member.

13. An electrosensing edge for reversing downward movement of a vertically-operated overhead door by an actuator when the door encounters an obstruction, said electrosensing edge comprising a relay electrically connected to the actuator; an electrically conductive mount bracket attached to the bottom edge of the door, said mount bracket also connected to said relay; a resilient sealing member suspended from said mount bracket; a pair of electrical insulators mounted on said mount bracket in spaced relationship with respect to each other inside said sealing member; an electrically conductive sensing cable extending through said electrical insulators in normally spaced, non-conducting relationship to said mount bracket, said sensing cable electrically connected to said relay for receiving an electric current during operation of the actuator, whereby downward movement of the door is reversed responsive to contact of said sensing cable with the obstruction and said mount bracket; and a cable clamp provided on each end of said sensing cable and at least one tension spring interposed between said cable clamp and said electrical insulator for exerting tension on said sensing cable.

* * * * *